US005277575A

United States Patent [19]

Newberry

[11] Patent Number: 5,277,575

[45] Date of Patent: Jan. 11, 1994

[54] SYSTEM AND METHOD FOR CONTROLLING THE OPERATION OF A PRIMARY BURNER

[75] Inventor: Richard D. Newberry, Hadley, Mass.

[73] Assignee: R. E. Phelon Company, Inc., East Longmeadow, Mass.

[21] Appl. No.: 875,419

[22] Filed: Apr. 29, 1992

[51] Int. Cl.[5] ..... F23N 5/00

[52] U.S. Cl. ..... 431/24; 431/70; 431/79

[58] Field of Search ..... 431/24, 26, 25, 78, 431/80, 71, 70, 79

[56] References Cited

U.S. PATENT DOCUMENTS

| | | | |
|---|---|---|---|
| 3,079,982 | 3/1963 | Staring | 431/24 |
| 3,364,971 | 1/1968 | Hayes | 431/24 |
| 3,514,242 | 5/1970 | Collins, Jr. | 431/79 |
| 3,816,053 | 6/1974 | Cade | 431/79 |
| 4,278,419 | 7/1981 | Bechtel et al. | 431/24 |

*Primary Examiner*—James C. Yeung
*Attorney, Agent, or Firm*—Chapin, Neal & Dempsey

[57] ABSTRACT

Disclosed is an electronic control system for controlling the operation of an oil burner heating system. The control system comprises a relay circuit having first and second relays. When the relays are closed, an external power source is connected to an igniter and motor. The control system also comprises a relay contact monitor configured to detect whether the relays contacts are welded. The control system also comprises a relay control circuit adapted to energize the relays in response to the call for heat from the thermostat and a signal from the relay contact monitor indicative that the relay contacts are not welded. The relays are configured such that only one relay will open or close with power across its contacts. The control system further comprises an improved flame sense monitor adapted to quickly output signals indicative of flame or no flame when such conditions are present with sensitivity hysteresis and a feature to adjust such hysteresis.

40 Claims, 9 Drawing Sheets

SYSTEM AND METHOD FOR CONTROLLING THE OPERATION OF A PRIMARY BURNER

FIELD OF THE INVENTION

The present invention relates generally to heating systems, and more particularly, to an electronic control system for controlling the operation of a burner igniter and pump motor used in an oil based heating system.

BACKGROUND OF THE INVENTION

Most homes, offices, and other dwellings have some type of heating system which includes some sort of control system that controls the "on" and "off" operation of the system. Although a wide variety of heating systems exist today, most involve the combustion of a fossil fuel as the energy source.

Oil based heating systems typically employ a motor/fuel pump to provide a combustible fuel/air mixture and an igniter to provide a spark to ignite the mixture. Conventional systems generally employ a switching device to connect an energy source to the igniter and motor in response to a call for heat from a thermostat.

Conventional switching devices utilize a relay. When the thermostat senses a temperature below the desired or set temperature, it closes and causes the relay to be energized. When the thermostat senses the preset temperature, the relay is de-energized, thereby disconnecting the igniter and motor from the energy source.

Although relays provide a convenient way of controlling application of electrical energy to the igniter and motor, they are susceptible to a variety of problems. In particular, the continuous "on" and "off" cycling of the heating system combined with power loading across the movable contact interface, may result in the movable contact being welded "closed," thereby rendering its relay inoperable to shut "off" the igniter and/or motor.

To overcome this problem, some switching systems are designed with two relays (which may be combinations of electro-mechanical or electronic relays) configured in series. In theory, if one relay becomes welded, the other relay would still function to turn "off" the igniter and motor when the thermostat is opened. However, this solution is at best a temporary one in that the system would continue to operate and because both relays have sustained wearing action, it is likely that the second relay contact will become welded at a subsequent heat cycle.

Conventional control systems are also designed such that the igniter and motor are turned "off" if no flame is detected after a certain period of time, commonly referred to as the trial for ignition (TFI) or start-up period. Such systems generally utilize a photocell adapted to detect a flame in the combustion chamber, and if no flame is present after the TFI period, the relays will be de-energized and the system is "locked-out" by activation of a lock-out circuit. Thereafter, the system can only be operated by manual activation of a reset switch. Photocells are typically adapted to operate in the thermal radiation region of the electromagnetic spectrum.

Use of an igniter in conjunction with a photocell that detects thermal radiation, presents a unique problem in that at start-up, the igniter gives off radiant heat which may cause the photocell to become activated before any combustion. If this occurs, the motor will continue to pump fuel into the combustion chamber which may lead to dangerous conditions. To overcome this problem, conventional flame sense circuitry is designed such that at start-up, it compensates for the additional radiant heat provided by the igniter. After the start-up period, the flame sense circuitry returns to a higher sensitivity level so that it can properly detect when the flame goes out.

Conventional flame sense circuitry, however, has several drawbacks. First, conventional circuitry is relatively imprecise in providing control signals indicative of whether "flame" or "no flame" exists. This is a disadvantage in that if a flame occurs at the end of the TFI period, the system may be "locked-out" unnecessarily due to the imprecise output of a control signal indicative of flame.

SUMMARY OF THE INVENTION

One object of the present invention is to provide a control system which can detect whether the relay contacts are "closed" and if so, to prevent energizing of the relays.

Another object of the present invention is to employ a switching device having two relays but which "open" and "close" at different times so that only one relay will close with power across its contacts.

An additional object of the present invention is to provide a flame sense monitor which quickly generates output signals indicative of whether or not a flame is present.

Another object of the present invention is to provide a flame sense monitor which has a simple and effective means for selecting different conditions for detecting "flame" or "no flame" (i.e., precise sensitivity levels with hysteresis, such that sensing flame and sensing loss of flame are at different sensitivity levels);

Still another object of the present invention is to provide a lock-out circuit which will be activated only by a "no flame" condition at the end of a TFI period and not by leakage currents induced into the lock-out circuitry.

The present invention is an electronic control system which, in the preferred embodiment, is configured to control the "on" and "off" operation of an igniter and motor. As will become apparent to those skilled in the art, however, the control system of the present invention may be easily adapted to control other types of heating systems, such as gas fired burners, for example.

The control system comprises a switching device which includes two relays and a time delay connected in circuit so that only one of the relays will have power across its contacts when they are "opened" or "closed". Should one relay become welded, the other relay will still be operable and would have no prior wearing action, thereby safely extending the operating life of the switching device.

The control system further comprises a relay contact monitor configured to detect whether or not the relay contacts are welded closed. If so, the relay contact monitor prevents both of the relays from being energized ever again.

The control system also comprises a flame sense monitor adapted to provide output signals indicative of whether a flame is present in the combustion chamber. In the preferred embodiment, the flame sense monitor includes two transistors which are never "on" at the same time. When one transistor is "on," it provides a signal indicative that no flame exists. When the other transistor is "on," it provides a signal indicative that a flame does exist. The flame sense monitor also includes a feedback loop from the output of the first transistor to the input of the second transistor, thereby providing rapid "toggling" action of the transistors and corresponding output signals indicative of whether or not a flame is present. In addition, the feedback loop provides a simple way of adjusting the sensitivity of the flame sense monitor to detect the presence of "flame" or "no flame" (i.e., it allows for an adjustable hysteresis "window.");

The control system also comprises a lock-out device which functions to prevent operation of the relays if no flame is present at the end of the TFI period and which further comprises a circuit to prevent activation of the lock-out circuit due to leakage currents.

BRIEF DESCRIPTION OF THE DRAWINGS

The present invention will be better understood from a reading of the following detailed description with reference to the accompanying figures in which.

DETAILED DESCRIPTION OF THE PREFERRED EMBODIMENTS

Figure 1:
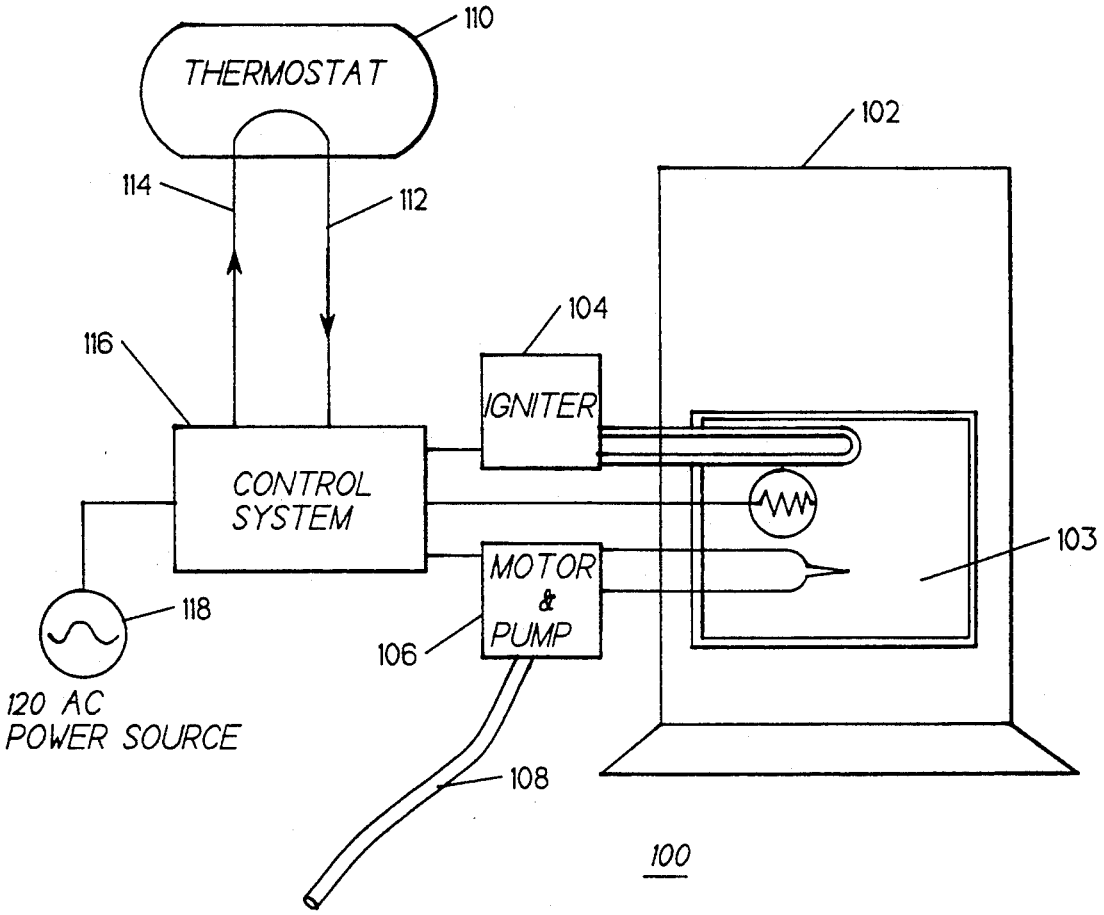
FIG. 1 is a schematic block diagram showing the environment of the control system of the present invention.

Referring first to FIG. 1, where a heating system 100 of the type embodying this invention is generally shown. Heating system 100 comprises a burner or heating device 102 having a combustion chamber 103. In the preferred embodiment, heating device 102 is preferably an oil-fired system for a steam, hot water, or forced air system.

The heating system 100 further comprises an igniter 104 and a motor, air blower, and fuel pump unit 106 (hereinafter "motor 106"). Motor 106 functions to drive the pump and blower to supply a fuel/air mixture into combustion chamber 103 via a fuel line 108. Igniter 104 provides a spark in combustion chamber 103 to ignite the fuel mixture. In the preferred embodiment, heating system 100 is a "continuous" burning system which does not require a continuous spark to maintain the combustion reaction.

Heating system 100 further comprises a thermostat 110 which functions according to its setting to provide a "call for heat" signal to a control system 116, along paths 112 and 114, when heat is required. Thermostat 110 may be of the type which "closes" and "opens" to maintain the heated space at its preset temperature.

Heating system 100 further comprises a flame sense detector 120 positioned within the combustion chamber 103 to sense whether or not there is flame in combustion chamber 103. In the preferred embodiment, detector 120 is a cadmium light detecting photocell whose resistance varies inversely to the radiant heat of the sensed flame.

Control system 116 functions to control the "on" and "off" operation of the igniter 104 and the motor 106 in response to a specific set of conditions. An electrical power source 118 provides 120 volt a.c. for operating control system 116.

Figure 2:
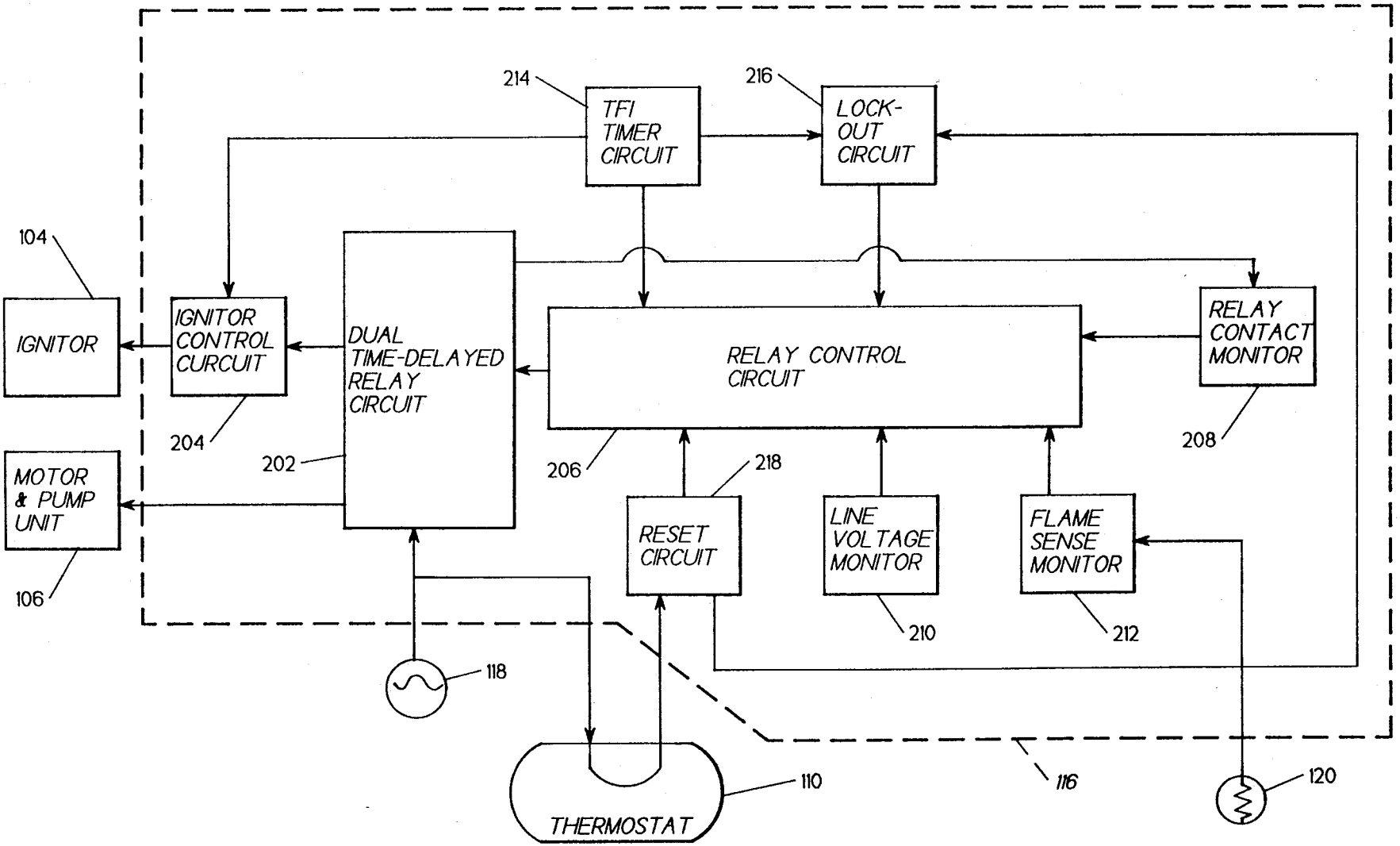
FIG. 2 is schematic block diagram showing the architecture of the control system.

A block diagram in FIG. 2 shows the principle components of control system 116. Control system 116 comprises a dual time delay relay 202 which when turned on, connects power source 118 to motor 106 and to igniter 104 via an igniter control 204. Dual relay 202 comprises two relays controlled in part by a time delay circuit so that only one relay will "open" or "close" with power across its contacts. This is an important feature of the present invention, in that it reduces the likelihood that both relays will simultaneously (or close in time) become welded "closed", thereby preventing the turning "off" of motor 104.

Igniter control 204 is adapted to receive an input from a TFI/recycle timer 214 along a path 238 to turn "off" the igniter 104 even when dual relay 202 remains closed. This feature is provided because in a continuous burning system, once a flame has been generated, the igniter 104 can be turned "off" approximately at the end of the TFI period.

Control system 116 further comprises a relay control 206 which functions to energize dual relay 202 along a path 246 in response to input signals from a relay contact monitor 208 along a path 226, a line voltage monitor 210 along a path 228, a flame sense monitor 212 along a path 230, timer 214 about a path 236, a lock-out device 216 along a path 244, and a reset device 218 about a path 220.

Relay contact monitor 208 receives an input signal from dual relay 202 along a path 224 and in turn, outputs a signal to relay control 206 indicative of whether or not the relay contacts are "open." If the contacts are in the "closed" position, relay control 206 will not be enabled.

Line voltage monitor 210 functions to sense whether or not a sufficient line voltage exists to turn on igniter 104 and motor 106. If a sufficient line voltage does not exist, relay control 206 will not be enabled.

Flame sense monitor 212 receives an input from photocell 120 along a path 232 and is adapted to provide an output signals indicative of whether or not a flame is present in the combustion chamber 103. A condition for enabling relay control 206 during the TFI period is that no flame is present in the combustion chamber 103.

If no flame is detected at the end of the TFI period, flame sense monitor 212 also outputs a signal along a path 234 to lock-out device 216 which will then become activated and thereafter outputs a "lock-out" signal to relay control 206. As long as this condition is present, relay control 206 cannot be enabled for subsequent TFI periods. This condition of "lock-out" can only be removed by actuation of reset device 218. Lock-out circuit 216 also comprises a circuit which prevents its premature activation due to leakage currents.

Timer 214 generally functions to output control signals indicative of the end of the TFI period and/or the ending of a recycle period. In the preferred embodiment, the TFI period is fifteen (15) seconds and the period for ending a recycle is seventy (70) seconds.

Reset device 218 functions to remove "lock-out" signals provided by lock-out device 216. Reset device 218 comprises a manual switch (not shown) which, when depressed, causes a signal to be sent to lock-out device 216 along a path 242. As also shown, thermostat 110 is connected through reset device 218 and to A.C. power source 118 via a transformer 250. This feature is provided so that control system 116 can be reset even when thermostat 110 is still activating the lock-out circuit while calling for heat.

Also shown in FIG. 2, is an alternate location for thermostat 110 where it is in series with the power source 118. This might be used, for example, in a boiler type application.

Figures 3, 3A:
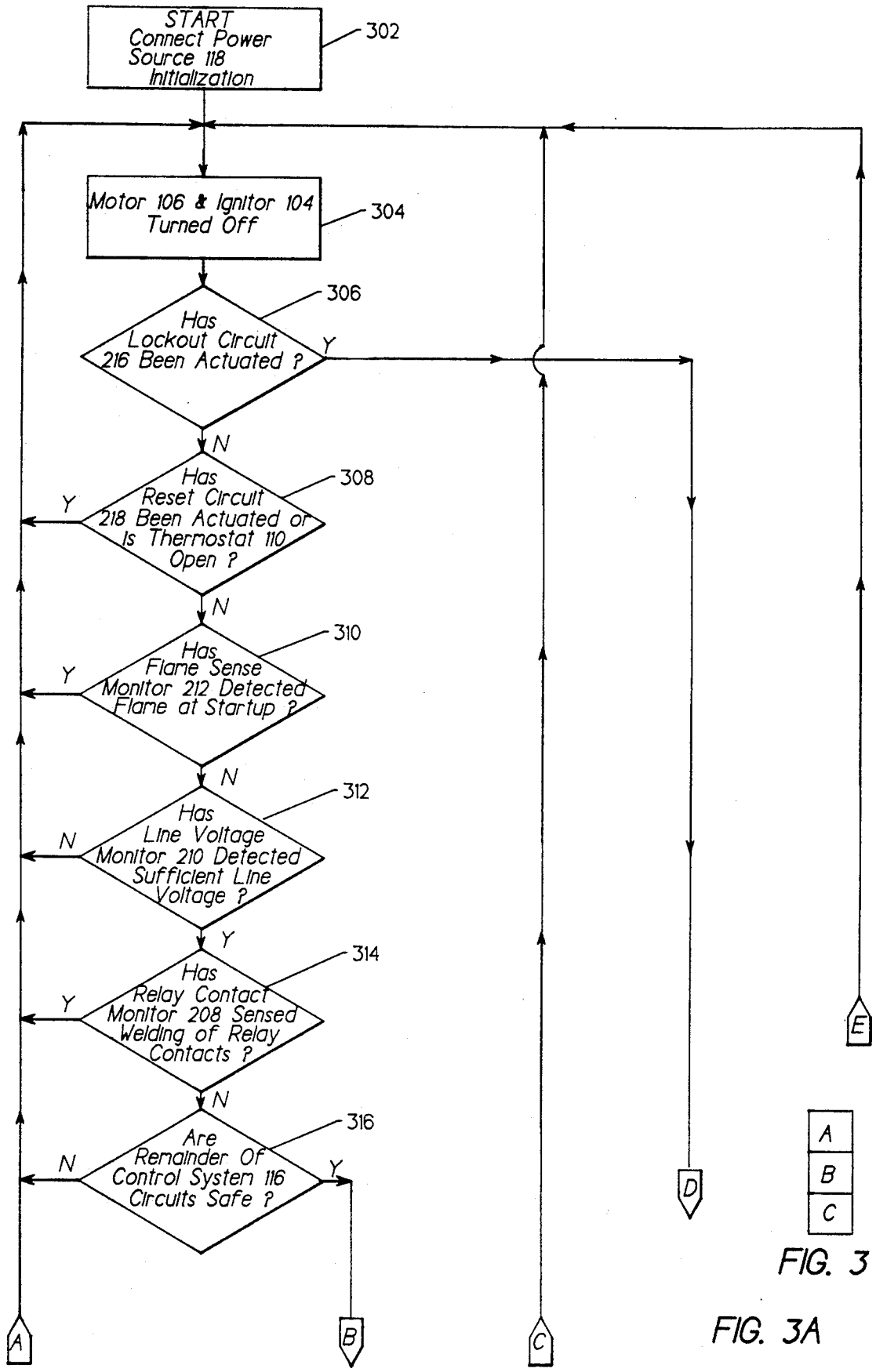
FIGS. 3A-3C are a high level flow chart showing the operational logic of the control system.
Figure 3B:
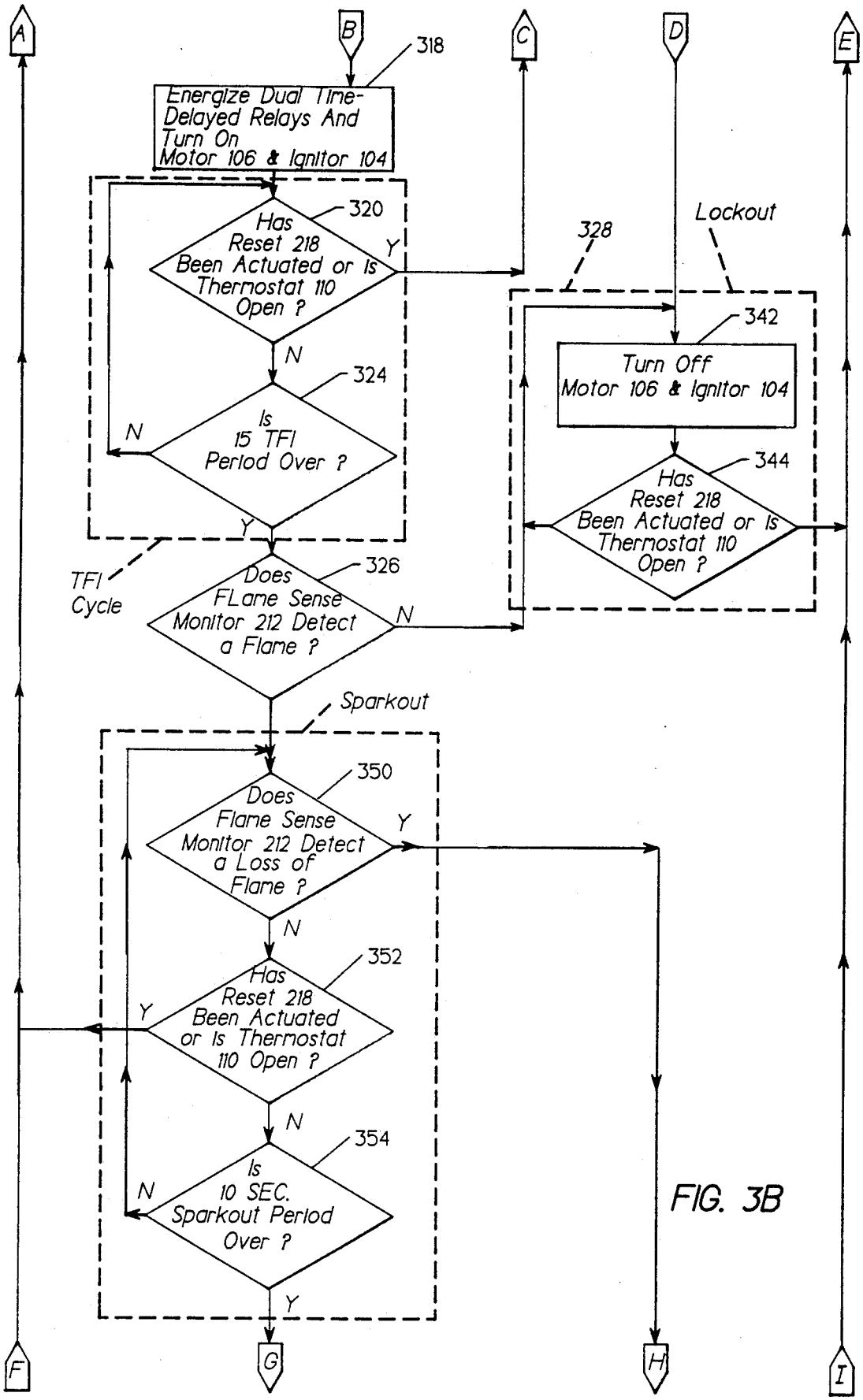
Figure 3C:
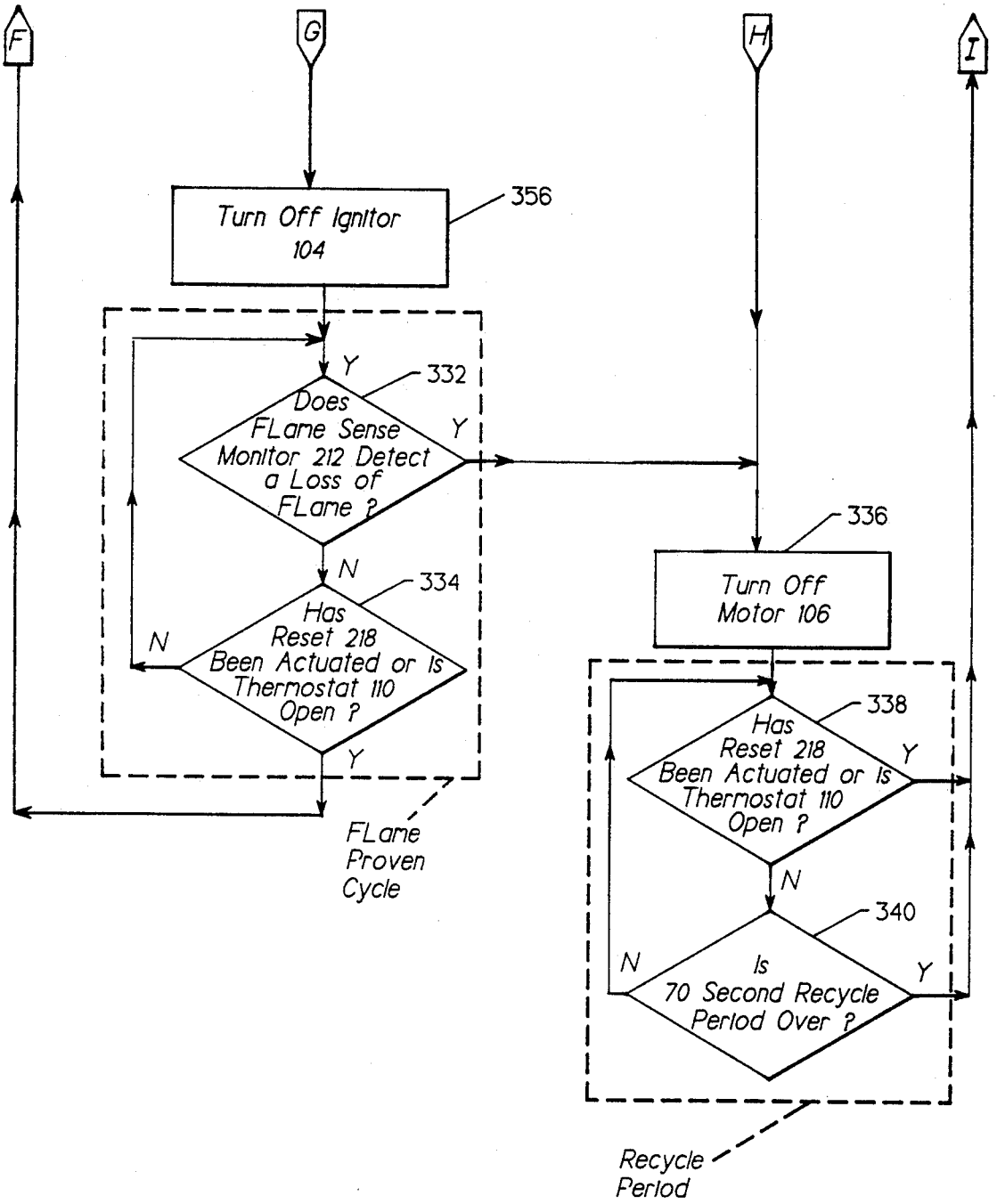

Referring to FIG. 3, a high level flow chart describes the general operation and logic of control system 116 with reference to FIG. 2. As shown at block 302, initialization of control system 116 occurs and power source 118 is connected to control system 116. Control is then passed to a block 304.

As represented by block 304, the motor 106 and igniter 104 are turned "off" and control is then passed to a decisional block 306.

As shown by decisional block 306, relay control 206 determines whether a lock-out signal is being provided by lock-out device 216. If a prior "lock-out" has occurred, then control is passed to lock-out logic (to be described). However, if no "lock-out" signal is present, control is passed to a decisional block 308.

As shown by decisional block 308, control system 116 monitors whether a reset signal has been received from reset device 218 or whether the thermostat 110 is "open" (i.e., no call for heat). If a reset signal has been received or if the thermostat 110 is "open," control is returned to block 304, where the motor 106 and igniter 104 remain "off." If, however, a reset signal has not been received and the thermostat is "closed" (i.e., a call for heat is present), then control is passed to a decisional block 310.

As shown by decisional block 310, relay control 206 checks if flame sense monitor 212 is outputting a signal indicative of "no flame" in the combustion chamber 103. If a flame exists, control is returned to block 304 where the igniter 104 and motor 106 remain "off." If, however, there is no flame, then control is passed to a decisional block 312.

As shown by decisional block 312, relay control 206 checks whether the line voltage monitor 210 is outputting a signal indicative that there is sufficient line voltage to turn "on" igniter 104 and motor 106. If there is not sufficient line voltage, control is returned to block 304 where the motor 106 and igniter 104 remain "off." If, however, there is sufficient line voltage, then control is passed to a decisional block 314.

As shown by decisional block 314, relay control 206 checks whether the relay contact monitor 208 is outputting a signal indicative that the relay contacts are welded closed. If the relay contacts are welded, control is returned to block 304 where the motor 106 and igniter 104 remain "off." If, however, the relay contacts are not welded, then control is passed to a decisional block 316.

As shown by decisional block 316, relay control 206 checks whether the remainder of the control circuitry is working properly. If some component is not working properly, control is returned to block 304 where the motor 106 and igniter 104 remain "off." If, however, the remaining circuits are working properly, control is passed to a block 318.

As shown by block 318, relay control 206 is enabled and energizes the dual relay 202 thereby connecting power source 118 to igniter 104 and motor 106. Control is then passed to a decisional block 320.

As shown by decisional block 320, control system 116 monitors whether a reset signal has been received from reset device 218 or whether the thermostat 110 has been opened. If either of these two conditions are present, control is returned to block 304. However, if no reset signal has been received and the thermostat 110 remains closed, control is passed to a decisional block 324.

As shown by decisional block 324, TFI timer device 214 monitors whether the 15 second TFI period is over. If the TFI period is not over, control is returned to decisional block 320. However, if the TFI period is over, control is passed to a decisional block 326.

As shown by decisional block 326, flame sense monitor 212 determines whether a flame is present in the combustion chamber. If no flame is present, control is passed to a block 342 where lock-out circuit 216 is adapted to output a "lock-out" signal which turns "off" motor 106 and igniter 104 and prevents relay control 206 from thereafter turning "on" the motor 106 and igniter 104. Control is then passed to a decisional block 344, where control system 116 determines if reset device 218 has been activated. If a reset signal is received, control is returned to block 304. If, however, no reset signal is received, control is returned to block 342 where system 116 remains "locked-out."

Returning to the other logic path of decisional block 326, if a flame exists, control is passed to a decisional block 350.

As shown by decisional block 350, flame sense monitor 212 is configured to detect whether a loss of flame has occurred. If a loss of flame has occurred, then control is passed to a block 336, where the motor 106 is turned "off" and a recycle period (to be described) is initiated. If, however, no loss of flame is detected, then control is passed to a decisional block 352.

As shown by decisional block 352, control system 116 monitors whether a reset signal has been received from reset device 218 or whether the thermostat 110 has been opened. If either of these two conditions are present, control is returned to block 304. However, if no reset signal has been received and the thermostat 110 remains closed, control is passed to a decisional block 354.

As shown by decisional block 354, the igniter control 204 monitors whether a ten (10) second "spark-out" period is over. If the 10 second spark-out period is not over, then control is returned to decisional block 350 where the decisional loop continues. If, however, the 10 second spark-out period is over, then control is passed to a block 356.

As shown by block 356, the igniter control 204 is configured to turn "off" the igniter 104. Control is then passed to a decisional block 332.

As shown by decisional block 332, flame sense monitor 212 monitors whether the flame has gone out. If the flame is still present, control is passed to a decisional block 334, where the control system 116 checks whether a reset signal has been activated or whether the thermostat 110 has been opened. If neither of these two conditions has occurred, control is returned to block 332, where flame sense monitor 212 continues to make sure that the flame has not gone out. If a reset signal is received or thermostat 110 has been opened, then control is returned to block 304, where the motor 106 is turned "off." Returning to the other logic path of block 332, if the flame sense monitor 212 determines that the flame has gone out, control is passed to a block 336.

As shown by block 336, control system 116 then operates to turn "off" the motor. Control is then passed to a decisional block 338.

As shown by a decisional block 338, control system 116 then checks whether reset device 218 has been activated or whether the thermostat 110 has been opened. If a reset signal has been received or if the thermostat has been opened, control is returned to block 304. If, however, a reset signal is not received and/or the thermostat remains closed, control is passed to a decisional block 340.

As shown by decisional block 340, control system 116 enters into a recycle period and timer 214 monitors whether a 70 second recycle period has expired. If the recycle period is not over, control is returned to decisional block 338. If, however, the recycle period is over, control is returned to block 304 where a new TFI period would begin.

Referring now FIGS. 4–7, where a schematic diagram of the circuit elements of control system 116 are shown. Power source 118 is connected to a primary winding 401 of a step-down transformer 402. A secondary winding 403 of transformer 402 is connected through thermostat 110 and across a half-wave rectifier consisting of a diode 404 and a capacitor 405 to thereby provide a common line circuit voltage 406. The circuit path from junction 407 returns to transformer 402 through reset device 218 so that control system 116 can be reset even though thermostat 110 remains closed.

Figure 4:
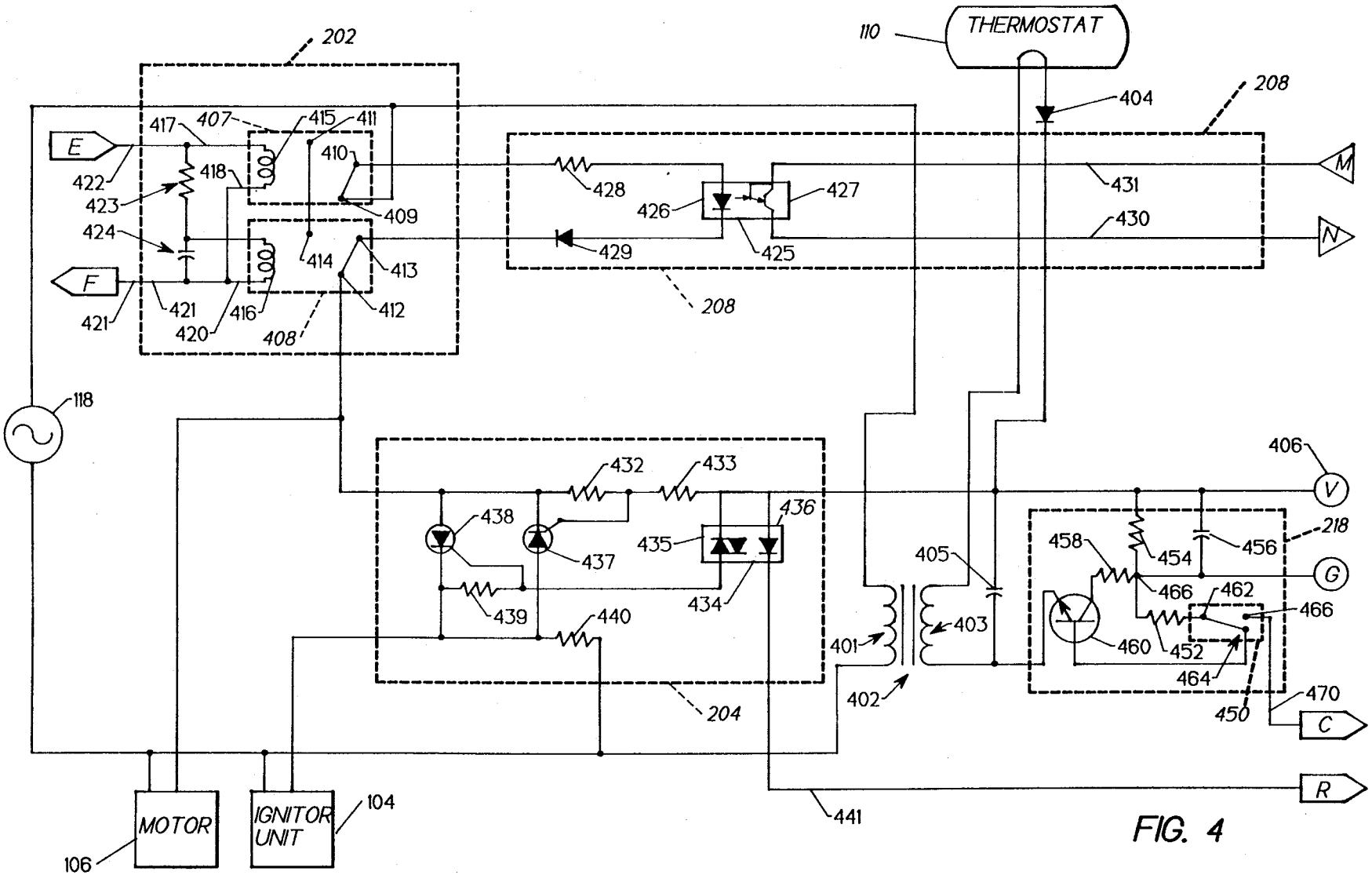
FIG. 4 is a schematic diagram showing the circuit elements embodying the present invention (dual time delay relay, igniter control, and relay contact monitor)

Dual relay 202, as shown in FIG. 4, comprises relays 407 and 408 which, in the preferred embodiment, are from C type relays and are normally in the "off" position as shown. Relay 407 has a movable contact 409 which is connected to power source 118, a closed contact 410 which is connected to relay contact monitor 208, an open contact 411, and a coil 415 having terminals 417 and 418.

Relay 408 has a movable contact 412 connected to igniter control 204 and to motor 106, a closed contact 413 connected to the relay contact monitor 208, an open contact 414 which is connected to open contact 411 of relay 407, and a coil 416 having terminals 419 and 420.

Figure 5:
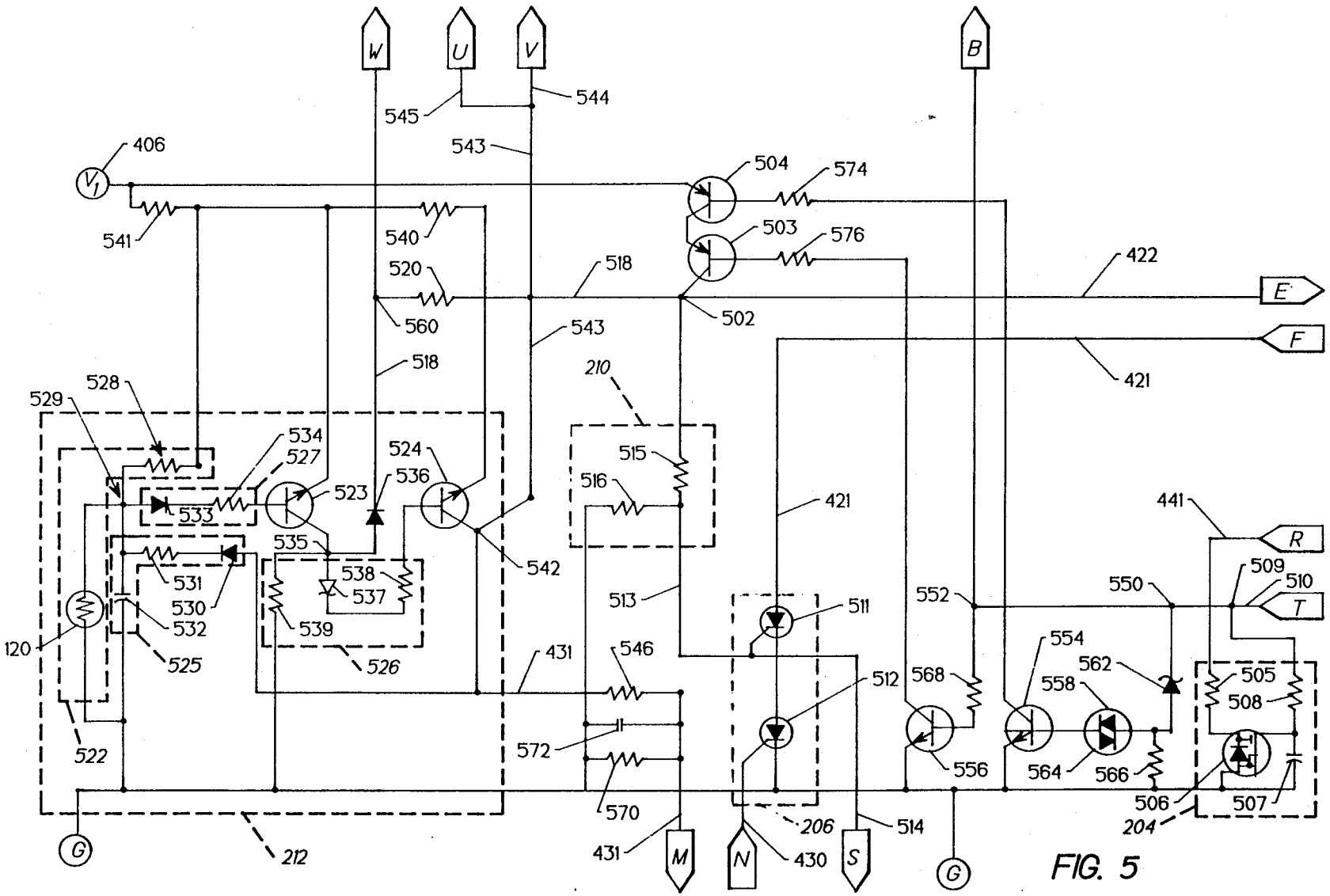
FIG. 5 is a schematic diagram showing the circuit elements embodying other features of the present invention (relay control, line voltage monitor, and flame sense monitor)
Figure 6:
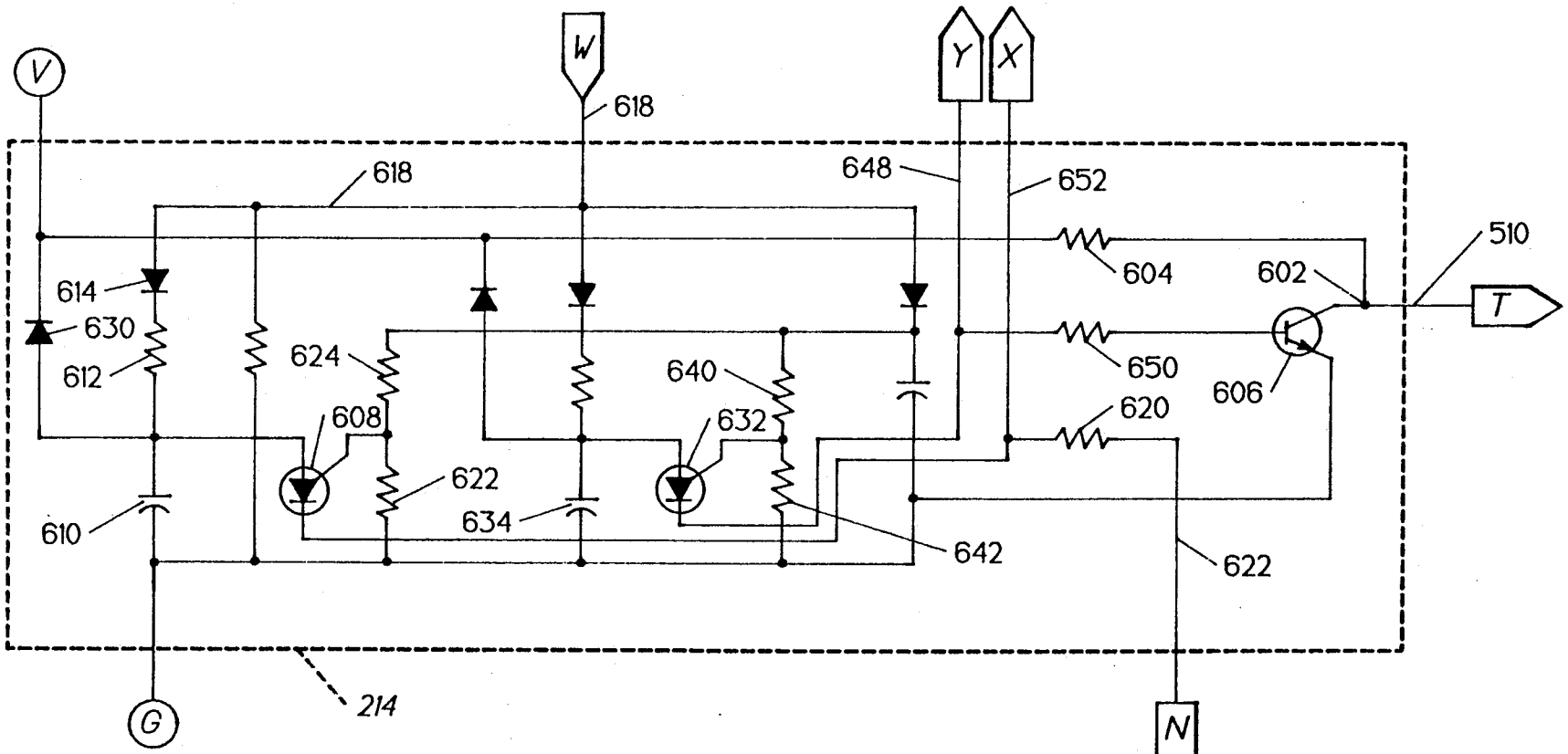
FIG. 6 is a schematic diagram showing the circuit elements of a TFI/recycle timer feature of this invention.

Terminal 418 of coil 415 and terminal 420 of coil 416 are connected along a path 421 via connector F to relay control 206 (FIG. 5). Terminal 417 of coil 415 is connected along a path 422 (via connector E to FIG. 5) to a node 502. Terminal 419 of coil 416 is connected to a time-delay circuit at a node 490. The time delay circuit comprises a resistor 423 and a capacitor 424 which are connected across coils 415 and 416. Resistor 423 and capacitor 424 function to provide a time delay such that relay 408 always opens and closes a predetermined time later than relay 407. As such, only relay 408 will "open" and "close" with power across its contacts, so that any erosion or welding of contacts will be limited to only one of the relays, namely relay 408. Therefore, even if relay 408 should become welded, relay 407 having been subjected to little wearing action, would continue to operate safely to avoid a system breakdown.

Igniter control 204, shown having circuits 204A (FIG. 4) and 204B (FIG. 5), comprises an optocoupler 434 having an input diode 436 and a triac output 435. The anode terminal of input diode 436 is connected to circuit voltage 406 at node 407. The cathode terminal of input diode 436 is connected along a path 441 (via connector R to FIG. 5) through a resistor 505 and a transistor 506 to ground. In the preferred embodiment, transistor 506 is a MOSFET having a gate terminal connected to a node 509 between a capacitor 507 and a resistor 508. Transistor 506 is turned "on" by a current flowing into node 509 which, as will hereinafter be described, is provided by timer 214 (FIG. 6) so that at the end of the TFI period, igniter 104 can be turned "off" independently of motor 106. Capacitor 507 has a capacitance such that when there is no current flow into node 509, transistor 506 will remain "on" for about ten (10) seconds (i.e., "sparkout" period).

Returning to FIG. 4, one side of triac output 435 of optocoupler 434 is connected via resistors 432 and 433 to movable contact 412 of relay 408. The other side of triac output 435 is connected to igniter 104 via a resistor 439 and to a.c. return via a resistor 440. Igniter control 204 further comprises silicon controlled rectifiers (SCR's) 437 and 438. The cathode terminal of SCR 437 is connected to resistor 432 and to movable contact 412 of relay 408, as shown. The anode terminal of SCR 437 is connected to igniter 104. The gate terminal of SCR 437 is connected to a junction between resistors 432 and 433, as shown. The anode terminal of SCR 438 is connected to movable contact 412 of relay 408, while the cathode terminal is connected to igniter 104 and one side of resistor 439. The gate terminal of SCR 438 is connected to triac output 435 and the other side of resistor 439, as shown.

When relays 407 and 408 are "closed", the positive phase of a.c. current from power source 118 is caused to flow via resistors 432 and 433, optocoupler 434 (which would have already been turned "on" at start of the TFI period) through resistor 439 and to resistor 440. As a result of this current flow, SCR 438 will turn "on" so that a major portion of the current will flow through the anode/cathode junction of SCR 438 directly to igniter 104.

Upon completion of the positive half-cycle, the a.c. current begins its negative phase with current flowing back through resistor 439, optocoupler 434, resistors 433 and 432 and through relays 408 and 407 to power source 118. SCR 438 will be turned "off" due to the change in current phase. However, similar to the beginning of the positive phase, SCR 437 will be turned "on" and a major portion of the current will flow through SCR 437.

Relay contact monitor 208 which senses the operating condition of relays 407 and 408, comprises an optocoupler 425 having a diode input 426 and a transistor output 427. The anode side of input diode 426 is connected to closed contact 410 of relay 407 through a resistor 428 while its cathode side is connected to closed contact 413 of relay 408 through a diode 429. The emitter of output transistor 427 is connected along a path 430 (via connector N to FIG. 5) to relay control 206 and its collector is connected along a path 431 (via connector M to FIG. 5) to one output of flame sense monitor 212.

When relays 407 and 408 are "open," current may flow from power source 118 through relay 407, resistor 428, input diode 426 of optocoupler 425, diode 429, relay 408, and the igniter control 204 through the resistor 440 and back to power source 118. Current flow through input diode 426 causes optocoupler 425 to turn "on," thereby allowing current flow from one output of flame sense monitor 212 (FIG. 5) along a path 431 (via connector M to FIG. 4) through optocoupler 425 along a path 430 (via connector N to FIG. 5) to relay control 206. As a result, two conditions for enablement of relay control 206 are provided, namely, no flame at start-up and no welding of relay contacts. If either relay 407 or 408 is not in the "open" position when the thermostat closes, current will not flow through optocoupler 425 and relay control 206 will not be enabled.

Referring to FIG. 5, relay control 206 generally comprises an SCR 511 in series connection with an SCR 512. The gate of SCR 511 is connected to line voltage monitor 210 at nodes 580 and 582. Line voltage monitor 210 is adapted to output a high enough voltage at node 580 to turn "on" SCR 511 if power source 118 has sufficient line voltage to turn "on" igniter 104 and motor 106. The remaining condition for supplying current to the gate of SCR 511 is provided by lock-out circuit 216. In particular, the gate of SCR 511 is also connected along a path 514 (via connector S to FIG. 7) to lock-out circuit 216. If lock-out circuit 216 is not activated, current will not be shunted away from node 582 and thus no current will flow into the gate of SCR 511. As such, two conditions, namely sufficient line voltage and no prior lock-out, are necessary to supply a current to the gate of SCR 511.

Similarly, two conditions, namely no flame at start-up and no welded relays, are also necessary in order to supply a current to the gate of SCR 512. The gate of SCR 512 is connected along a path 430 (via connector N to FIG. 4) to optocoupler 425, which in turn is connected along a path 431 (via connector M to FIG. 5) through a resistor 546 to node 542 of flame sense monitor 212. A resistor 570 and capacitor 572 are also shown connected between resistor 546 and ground. If no flame is detected by the flame sense monitor 212 at start-up (i.e. a voltage at node 542) and if the contacts of relays 407 and 408 are not welded (i.e. "open" and optocoupler 425 is thus "on"), current from node 542 will flow into the gate of SCR 512 along the path described above.

If SCR's 511 and 512 are both "on," a current path is provided from circuit voltage 406 through PNP type transistors 504 and 503 into node 502 along the path 422 (via connector E to FIG. 4) through coils 415 and 416 of relays 407 and 408, along a path 421 (via connector F to FIG. 5) through SCR's 511 and 512 to circuit ground.

Line voltage monitor 210 comprises a voltage divider circuit having resistors 515 and 516 whose output is node 580 connected to node 582 which is in turn connected to the gate of SCR 511. Resistor 515 is also connected to node 502, while resistor 516 is also connected to ground. At start-up, transistors 503 and 504 are turned "on" thereby providing a flow of current from circuit voltage 406 through the transistors 503 and 504 into resistor 515. Because voltage 406 is provided by a known power source 118, the resistance of resistor 516 can be selected to provide the minimum voltage necessary at node 580 to turn "on" SCR 511. Accordingly, should the a.c. power be too low, the output voltage at node 580 will also be too low to turn "on" SCR 511.

Flame sense monitor 212 (FIG. 5) generally comprises a flame sense detection circuit 522, transistors 523 and 524, a voltage adder 525, and voltage threshold circuits 526 and 527.

Flame sense detection circuit 522 comprises a resistor 528 and photocell 120 (heretofore described), connected together to form a voltage divider having an output connected to a node 529. The other side of resistor 528 is connected through a resistor 541 to circuit voltage 406. The other terminal of photocell 120 is connected to circuit ground.

Voltage adder 525 comprises a diode 530, a resistor 531, and a capacitor 532. The cathode side of diode 530 is connected to node 529 across resistor 531. The anode side of diode 530 is connected to the collector of transistor 524 at node 542. Capacitor 532 is connected to node 529 and to circuit ground.

Voltage threshold device 527 comprises a zener diode 533 and a resistor 534. The anode terminal of zener diode 533 is connected to node 529, while its cathode terminal is connected by resistor 534 to the base of transistor 523 which, in the preferred embodiment, is a PNP type transistor.

The emitter of transistor 523 is connected to circuit voltage 406 via resistor 541, while its collector is connected to a node 535. Node 535 is connected via a diode 536 and along a path 518 to a node 560. The collector of transistor 523 is also connected through node 535 to voltage threshold device 526.

Voltage threshold device 526 comprises a zener diode 537 and resistors 538 and 539. The anode terminal of zener diode 537 is connected to ground through node 535 and resistor 539. The cathode terminal of diode 537 is connected by resistor 538 to the base of a PNP type transistor 524.

The emitter of transistor 524 is connected by resistor 541 to circuit voltage 406 while its collector is connected to node 542. Node 542 is connected along a path 543 and paths 544 and 585 (via connectors U and V to FIG. 7) to lock-out circuit 216. Node 542 is also connected along a feedback path 582 to the anode terminal of diode 530.

At start-up, if no flame is present in combustion chamber 103, photocell 120 has a high resistance so that current supplied by circuit voltage 406 is caused to flow through resistor 528 into node 529 to charge up capacitor 532 to thereby maintain the voltage potential at node 529 higher than the breakdown voltage of zener diode 533. As a result, no current can flow out of the base of transistor 523 thereby preventing it from turning "on." The resistance value for resistor 528 is selected such that during start-up, if the only radiant heat being sensed by photocell 120 is that due to igniter 104, the voltage potential at node 529 will be higher than the breakdown voltage of zener diode 533 so that transistor 523 will remain "off."

When transistor 523 is "off," a voltage at node 535 exists which is lower than the breakdown voltage of zener diode 537, thereby allowing current to flow from base of transistor 524 through resistors 538 and 539 to ground, causing transistor 524 to turn "on."

When transistor 524 is fully turned "on," the majority of current flows from circuit voltage 406 via resistor 541, through the emitter-collector junction to node 542. A portion of the current into node 542 is passed along path 431 across resistor 546 and (via connector M to FIG. 4) to relay contact monitor 208 thereby providing one condition for enablement of SCR 512, namely no flame at start-up. A portion of the current from node 542 is also returned back along path 582 to diode 530 through resistor 531 which causes the voltage at node 529 to increase quickly, thereby rapidly turning transistor 523 "off." This feedback loop thereby provides a continuous and rapid toggling action of transistor 523.

If a flame occurs during the TFI period, the resistance of photocell 120 will begin to decrease. When the resistance in the photocell 120 drops to a low enough value (also referred to as the "cross-over resistance"), current will flow from node 529 through photocell 120 to ground, thereby creating a voltage potential at node 529 which is lower than the breakdown voltage of zener diode 533. As a result, current will flow out of the base of transistor 523 through zener diode 533 to turn it "on", which causes the voltage at node 535 to increase, thereby preventing current flow from the base of transistor 524 to ground and turning it "off". With transistor 524 turned "off," no current will flow from its collector through diode 530 and resistor 531, thereby quickly decreasing the voltage at node 529 and toggling "on" of transistor 523.

Should the flame go out thereafter, the resistance in photocell 120 will increase to a point (also referred as the "cross-over resistance"), at which the voltage at node 529 is above the breakdown voltage of zener diode 533, thereby causing transistor 523 to partially turn "off." Partially turning "off" of transistor 523 also causes transistor 524 to partially turn "on" which causes a feedback current to exist. The feedback current quickly increases the voltage at node 529, thereby rapidly turning "off" of transistor 523.

The operation of the feedback loop also provides an effect similar to hysteresis, in which the cross-over resistance for turning "on" transistor 523 (i.e. flame) is different than the cross-over resistance required to turn transistor 523 "off" (i.e. no flame). In the preferred embodiment, the cross-over resistance required for detecting "flame" is lower than that for detecting "no flame." The amount of hysteresis can be easily selected by setting the value of resistor 531 which determines the feedback current.

Timer 214 (FIG. 6) comprises line voltage source 406 which is connected by a resistor 604 to node 602. Node 602 is connected to the collector of a NPN type transistor 606 and along a path 510 (via connector T to FIG. 5) to nodes 587, 550 and 552. During the TFI period, transistor 606 is "off" and current is provided from voltage source 406 to nodes 587, 550, and 552, thereby turning "on" NPN type transistors 506, 554 and 556, respectively. However, at the end of TFI period, transistor 606 will be turned "on" whereby current will be shunted through transistor 606 to circuit ground, thereby turning "off" transistors 506, 554, and 556.

Timer 214 further comprises a programmable unijunction transistor (PUT) or thyristor 608 having its anode terminal connected to node 609 which is connected to a capacitor 610 and by a resistor 612 and a diode 614 along a path 618 (via connector W to FIG. 5) to node 560, where current is received from the collector of transistor 503 across a resistor 520 (during TFI) and the collector of transistor 523 (after the TFI period if a flame is detected). The capacitance of capacitor 610 is related to the length of the TFI period and in the preferred embodiment, its capacitance is such that it will take about 15 seconds to become charged sufficiently to turn on thyristor 608. The cathode of thyristor 608 is connected along a path 652 (via connector X to FIG. 7) across a capacitor 708 to the gate of a SCR 702 of lock-out circuit 216. The cathode terminal of thyristor 608 is also connected by a resistor 620 along a path 622 (via connector N to FIG. 7) to the base of transistor 706 of lock-out circuit 216. The gate terminal of thyristor 608 is connected to a voltage divider consisting of resistors 622 and 624, by a capacitor 628 and diode 626 and along path 618 (via connector W to FIG. 5) to node 560, where it also receives current from the collector of transistor 503 (during TFI) and the collector of transistor 523 (if a flame is detected).

A diode 630 is connected from capacitor 610 to circuit voltage 406 to thereby discharge capacitor 610 when the circuit voltage 406 is shorted to ground by actuation of reset device 218 or opening of thermostat 110.

Timer 214 further comprises a redundant timer circuit consisting of a programmable unijunction transistor (PUT) or thyristor 632, capacitor 634, diode 638, resistor 636, diode 644, resistors 640 and 642. These elements operate in the same manner as the corresponding elements of the timer circuit embodying thyristor 608. However, the cathode of thyristor 632 is connected to a node 646 which is connected in part, along a path 648 (via connector Y to FIG. 7) and to the gate of a SCR 704 across a capacitor 760. Additionally, the cathode of thyristor 632 is connected through node 646 and a resistor 650 and to the base of transistor 606.

Figure 7:
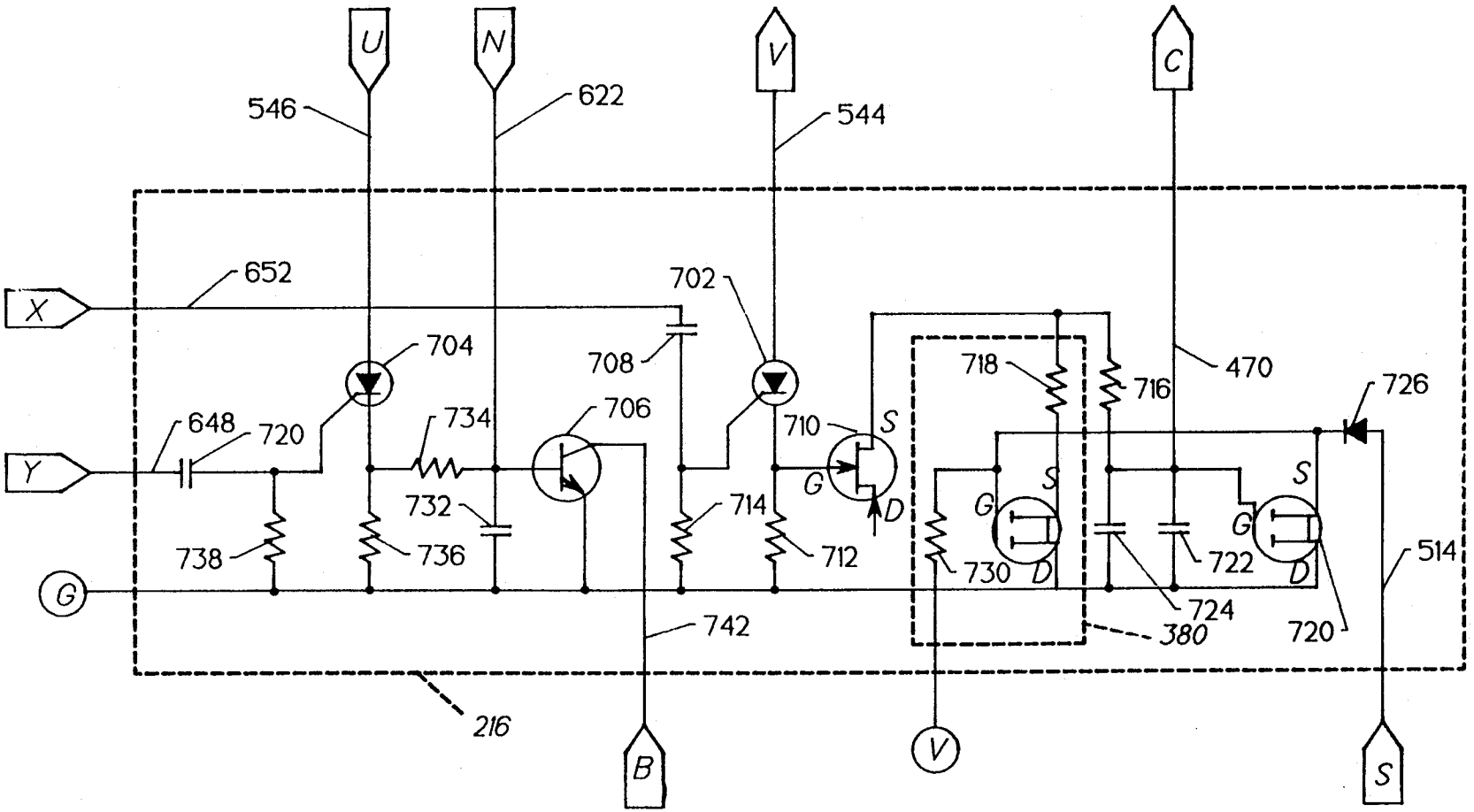
FIG. 7 is a schematic diagram showing the circuit elements of a lock-out feature of the invention.

Referring to FIG. 7, lock-out device 216 comprises SCR 702 having an anode terminal connected along path 544 (via connector V to FIG. 5) to node 542 of the flame sense monitor 212. As described heretofore, the gate of SCR 702 is connected through capacitor 708 along path 652 (via connector X to FIG. 6) to the cathode terminal of thyristor 608 of the TFI Timer 214. A resistor 714 connects capacitor 708 to ground. Capacitor 708 functions to allow current to flow into the gate of SCR 702 only while it is being charged.

The cathode terminal of SCR 702 is connected to a resistor 712 and to the gate of a transistor 710, which in the preferred embodiment is a J-FET type transistor. To turn on SCR 702, two conditions must be present at the same time. One condition is that the TFI period must have expired which is represented when a current flows from timer 214 via connector X into the gate of SCR 702. The second condition is that no flame is present at the end of the TFI period. This condition is represented by a current flow from flame sense monitor 212 via connector V into anode terminal of SCR 702.

The source terminal of transistor 710 is connected by a resistor 716 to the gate terminal of a transistor 720, which in the preferred embodiment is a MOSFET type transistor. The gate terminal of transistor 720 is also connected to capacitors 722 and 724 which when charged, will keep transistor 720 "on" even when the thermostat 110 is open and closed again. As will be described more fully herein, positive actuation of reset device 218 is required in order to begin a new TFI period.

The drain terminal of transistor 720 is connected to ground while the source terminal is connected through a diode 726 along path 514 (via connector S to FIG. 5) to node 582 of the relay control 206. The source terminal of transistor 710 is also connected by a resistor 718 to the source terminal of a transistor 728 of a leakage current drain circuit 750, which in the preferred embodiment is a MOSFET type transistor.

Leakage current drain circuit 750 functions to prevent the accidental turning "on" of transistor 720 due to leakage currents charging capacitors 722 and 724. The drain terminal of transistor 728 is connected to circuit ground, while the gate terminal is connected by a resistor 730 to circuit voltage 406. The gate of transistor 728 is also connected to the cathode terminal of diode 726 and the source terminal of transistor 720.

Lock-out circuit 216 further comprises SCR 704 and transistor 706 which in the preferred embodiment is a NPN type transistor. The anode terminal of SCR 704 is connected along a path 585 (via connector U to FIG. 5) to node 542. As described heretofore, the gate of SCR 704 is connected by capacitor 760 and along path 648 (via connector Y to FIG. 6) to the cathode terminal of thyristor 632 of the TFI timer circuit. The cathode of SCR 704 is connected to the base of transistor 706 by a resistor 734 and to ground via a resistor 736. The base of transistor 706 is also to circuit ground across a capacitor 732 and along path 622 (via connector N to FIG. 6) to the cathode terminal of thyristor 632 of the TFI timer circuit. The collector of transistor 706 is connected along a path 742 (via connector B to FIG. 5) to node 552.

Reset device 218 (FIG. 4) generally comprises a switching device 450, resistors 452, 454, and 458, a capacitor 456 and a transistor 460, which in the preferred embodiment is a NPN type transistor. In the preferred embodiment switch 450 is a manual spring loaded switch having a movable contact 462, a closed contact 464, and an open contact 466. Switch 450 is shown in its normally closed position with movable contact 462 in electrical connection with closed contact 464. When switch 450 is actuated, the movable contact 462 will be moved into electrical contact with open contact 466.

Contact 464 is connected to the base of transistor 460. The open contact 466 is connected along a path 470 (via connector C to FIG. 7) to capacitors 722 and 724 of lock-out circuit 216. Contact 462 is connected by resistor 452 to a node 467 and through resistor 454 to circuit voltage 406. The collector of transistor 460 is connected by resistor 458 to node 466. The emitter of transistor 460 is connected to one side of capacitor 405 and to secondary winding 403 of transformer 402.

When switch 450 is in the position shown and the thermostat 110 closes, current flows through resistors 454 and 452, through switch 450 and into the base of transistor 460 thereby turning it "on." Thereafter, a current flows through resistors 454 and 458, through transistor 460 and to winding 403 of transformer 402. When switch 450 is actuated, a path is provided from ground to resistor 452, through switch 450 along a path 470 (via connector C to FIG. 7) to capacitors 722 and 724, thereby providing a path to ground for discharging the capacitors and disenabling lock-out circuit 216. Additionally, opening of switch 450 causes transistor 460 to turn "off," thereby opening circuit voltage 406 ground.

OPERATION OF THE PRESENT INVENTION

1. Start of 15 second TFI Period

When a call for heat occurs, thermostat 110 (FIG. 4) a circuit path through secondary winding 403 of step down transformer 402 is closed and A.C. current is induced into the secondary winding. Diode 404 and capacitor 405 transform the A.C. current into a D.C. current having a circuit voltage 406 of approximately 24 volts.

If no flame is detected in combustion chamber 103, the resistance of photocell 120 will remain high, thereby causing transistor 523 to remain "off" and transistor 524 to turn "on." As such, the flame sense monitor 212 is output a signal via transistor 524 indicative of no flame at start-up. In particular, when transistor 524 is "on", current will flow through resistor 541, through transistor 524 to node 542. A portion of the current into node 542 will flow through resistor 546 along path 431 (via connector M to FIG. 4) to optocoupler 425. The condition of "no flame at start-up" would then be satisfied. In addition, a portion of the current into node 542 will flow along path 543 (via connectors U and V to FIG. 7) to anode terminals of SCR's 704 and 702, respectively, thereby providing a status of "no flame" to lock-out circuit 216.

At the same time, current also flows through resistor 604 (FIG. 6) into node 602, and because transistor 606 is "off", all of the current into node 602 flows along path 510 (via connector T to FIG. 5) to nodes 587, 550, and 552. A voltage at node 552 causes a current to flow through a resistor 568 and into the base of transistor 556, thereby turning it "on" which in turn will cause transistor 503 to turn "on," by providing a current path from its base through a resistor 576 to ground.

When sufficient voltage is present at node 550, current will flow through a zener diode 562, through a triac 564, resistor 566, and into the base of transistor 554, thereby causing it to turn "on". When transistor 554 turns "on", current will flow out of the base of transistor 504 through resistor 574 and transistor 554 to ground, thereby turning transistor 504 "on."

When transistors 503 and 504 are both turned "on," current will flow from voltage 406 through transistor 503 and 504 and into node 502, from which it is distributed to several circuits as follows:

(a) a portion of current into node 502 flows through resistor 520 and (via connector W to FIG. 6) to timer 214 where capacitors 610 and 634 are charged, thereby starting the 15 second TFI period; and (b) a portion of the current into node 502 also flows through line voltage monitor 210, causing a current to flow into node 582.

If no lock-out signal is provided by lock-out circuit 216, then current into node 582 will flow into the gate of SCR 511 of relay control 206. If, however, a prior lock-out had occurred, current into node 582 would be shunted away from the gate and caused to flow along a path 514 (via connector S to FIG. 7) through diode 726 and transistor 720 to ground. Assuming no prior lock-out, two conditions for turning "on" of SCR511 are present, namely that a sufficient line voltage exists and no prior lock-out has occurred.

A voltage at node 587, causes a current to flow through resistor 508 and into node 509 and capacitor 507. When capacitor 507 is charged, current will flow from node 509 and into the gate of transistor 506 causing it to turn "on" which in turn, causes optocoupler 434 to turn "on", thereby connecting relays 407 and 408 directly to igniter 104. The specific flow path is as follows: current flow from voltage source 406, through optocoupler 434 (via connector R back to FIG. 5), via resistor 505 and transistor 506 to ground.

If relays 407 and 408 are in the "open" position, a.c. current flows through input diode 426 of optocoupler 425 causing it to turn "on." The specific current path is as follows: through relay 407, resistor 428, through input diode 426 of optocoupler 425, diode 429, relays 408, resistors 432 and 433, through output triac 435 of optocoupler 434, through resistors 439 and 440 and back to power source 118.

As heretofore described, flame sense monitor 212 has already detected "no flame" at start-up and transistor 524 has been turned "on." Accordingly, once optocoupler 425 is turned "on," current will flow through it and into the gate of SCR 512. The specific current flow path is as follows: current flow from node 542 along path 431 across resistor 546 (via connector M to FIG. 4) through output transistor 427 of optocoupler 425 along a path 430 (via connector N to FIG. 5) and into the gate of SCR 512 of control circuit 206.

All conditions for turning "on" of SCR's 511 and of relay control 206 have been satisfied: (1) no flame at start up, (2) no prior lock-out, (3) sufficient line voltage and (4) relay contacts are not welded. SCR's 511 and 512 turn "on" thereby energizing relays 407 and 408. More specifically, a portion of the current into node 502 will now flow along circuit path 422 (via connector E to FIG. 4) into coil 415 causing relay 407 to "close", and after a period of time (once capacitor 424 has been charged), into coil 416 thereby causing relay 408 to "close."

When relays 407 and 408 are "closed", a.c. current from power source 118 will flow to motor 106 thereby causing the same to turn "on."A.C. current will also flow to igniter control 204 and then to igniter 104.

2. End of TFI Period

When capacitors 610 and 634 (FIG. 6) of the timer 214 have been charged, a current is supplied to the anode and gates of thyristor's 608 and 632. Turning "on" of thyristor 632 causes transistor 606 to turn "on," thereby shunting current away from node 602 to ground and thus nodes 587, 550, and 552, to thereby turn "off" transistors 554 and 556, which in turn, cause transistors 503 and 504 to turn "off", thereby in effect disconnecting voltage 406 from node 502. However, transistor 506 of the igniter control 204 will not turn "off" until after the "spark-out" period which is controlled by the discharge rate of capacitor 507. Once transistor 506 is turned "off" (10 seconds after the TFI period), optocoupler 434 of igniter control 204 is turned "off", and as such, so is igniter 104.

(a) If a flame is detected by photocell 120, its resistance will decrease, thereby completing a path for current flow out of the base of transistor 523, through resistor 534, zener diode 533, photocell 120 and to circuit ground. As a result of this current flow, transistor 523 is turned "on" and current flow occurs from voltage source 406 through resistor 541, through transistor 523 and into node 535. Current flow into node 535 increases the voltage potential at node 535 thereby preventing current flow out of the base of transistor 524, thereby turning "off" the same.

A portion of the current flow into node 535 is caused to flow through diode 536 and into node 560. A large portion of the current into node 560 is caused to flow to coils 415 and 416 of relays 407 and 408 thereby keeping the same energized even though transistors 503 and 504 have been turned "off." The status of control circuit 206 remains the same as long as (1) a flame continues to be detected by photocell 120, (2) reset device 218 is not activated, and (3) thermostat 110 remains closed. The remainder of the current into node 560 is caused to flow along path 618 (via connector W to FIG. 6) to keep capacitors 610 and 634 of timer 214 charged, and as such, maintains a control signal to lock-out circuit 216 indicative that the TFI period is over.

(b) If no flame is detected by photocell 120 at the end of the TFI period, transistor 523 remains "off" and transistor 524 remains "on." As a result thereof, no current is provided to node 560 and as such, no current flows through relay coils 415 and 416. Accordingly, relays 407 and 408 lose power and turn "off."

As a result of transistor 524 remaining "on," a voltage exists at the anode terminals of SCR's 702 and 704 of lock-out circuit 216. Concurrently, current is applied at the gates of SCR's 702 and 704, thereby causing them to turn "on."

Turning "on" SCR 704 causes a current to flow into the base of transistor 706 thereby permanently turning "on" transistor 706, creating a lock-out condition in that any current that may be flow into node 552 (FIG. 5) is shunted away from transistor 556 to circuit ground.

Similarly, the turning "on" of SCR 702 causes a lock-out condition, in that current is caused to flow into the gate of transistor 710 and then across resistor 716 into capacitors 722 and 724. After capacitors 722 and 724 have been charged up, current flows into the gate of transistor 720 turning it "on." Turning "on" of transistor 720 creates a circuit path from node 582 across diode 726, through transistor 720 to circuit ground, and as such, any current flowing into node 582 will be shunted away from the gate of SCR 511 and passed to circuit ground. This condition will remain in effect at node 582 until a reset device 218 is actuated.

3. Opening of thermostat 110:

Assuming that a flame was detected as explained in section 2(a) above, and that at a point thereafter, the thermostat 110 "opens". Opening of thermostat 110 would prevent current flow therethrough and as such voltage 406 would dissipate. Concurrently, no current would flow through transistor 523 and as such, no current would flow to node 560 and thus relays 407 and 408 would be de-energized. No current flow through transistor 523 would also prevent current flow along path 618 (via connector W to FIG. 7) to timer 214, thereby causing capacitors 610 and 634 to discharge to ground via diodes 630 and 638, respectfully. Timer 214 is reset and is ready for the next call for heat and a new TFI period.

4. Flame re-cycle period:

If the flame in the combustion chamber goes out due to some event other than switching of thermostat 110 or actuation of reset device 218, for example, by a discontinuation of fuel via motor 106, control system 116 would behave as follows.

Transistor 523 would turn "off" and no current would be provided to node 560. However, because thermostat 110 is still closed, transistor 524 would turn on.

As a result of transistor 523 turning "off," no current is provided to node 560 and relays 407 and 408 will lose power thereby opening and turning motor 106 "off." Additionally, the turning "off" of transistor 523 results in no current to timer 214 and as such, capacitors 610 and 634 will begin to discharge through thyristors 608 and 632 along paths 652 and 648 (via connectors X and Y to FIG. 7) through resistors 714 and 738 to circuit ground. A recycle period (or how long it takes to begin a new TFI period) is dependant on how long it takes to discharge capacitors 610 and 634. As heretofore described, TFI timer circuit is designed such it will take about seventy (70) seconds for capacitors 610 and 634 to discharge through thyristor's 608 and 632. Once capacitors 610 and 634 have been discharged, transistors 606 and 706 are turned "off" thereby initiating a new TFI period.

5. Actuation of reset device 218

Should lock-out device 216 become activated as heretofore described, the only way to begin a new TFI period, regardless of the status of the thermostat 110, is to actuate reset device 218. When contact 464 is closed, capacitors 722 and 724 are connected to circuit ground along path 470 to (via connector C to FIG. 7), thereby discharging the capacitors and removing the lock-out condition at node 582. Opening of switch 450 also causes transistor 460 to turn "off" and current flowing from thermostat 110 is now stopped. As a practical mater, circuit voltage 406 is open-circuited, thereby eliminating the presence of circuit voltage source 406 everywhere in the control system 116. The reset feature also allows the resetting of the control system even when no lock-out has occurred prior. In many situations, a technician may want to reset the system without having to open and close the thermostat.

Upon closing of switch 450, if the thermostat 110 is closed, a new TFI period will commence.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed:

1. A control system for controlling the operation of a heating system having a combustion chamber, a thermostat, an igniter, a pump motor, the thermostat being adapted to generate a call for heat, the igniter and motor being powered by an electrical energy source and adapted to supply a spark and fuel to the combustion chamber, the control system comprising:

(a) a relay circuit having first and second relays, each of said relays having an open position and a closed position, the energy source being connected to the igniter and motor through said first relay and said second relay and when said first and said relays are closed;

(b) a relay contact monitor in electrical circuit with said relays and configured to output a first signal when said relays are in said open position and a second signal when said relays are in said closed position; and (c) a relay control configured to energize said relays in response to the call for heat from said thermostat and said first signal from said relay contact monitor.

2. The control system of claim 1, wherein said relay contact monitor comprises a switching device connected to said relays and to said relay control circuit, said switching device being adapted to provide said first and second signals.

3. The control system of claim 2, wherein said switching device is an optocoupler.

4. The control system of claim 3, wherein said optocoupler has an input diode and output transistor.

5. The control system of claim 4, wherein said input diode is connected to said relays and said output transistor is connected to said relay control circuit.

6. The control system of claim 1, wherein said first and second relays are connected to a time delay circuit to thereby close said second relay after said first relay.

7. The control system of claim 6, wherein said time delay circuit comprises a resistor and capacitor.

8. The control system of claim 1, further comprising a flame sense monitor adapted to generate a third signal when a flame is detected in the combustion chamber and a fourth signal when a flame is not detected in the combustion chamber, said relay control being further configured to energize said relays in response to said first signal from said relay contact monitor, the call for heat from the thermostat, and said fourth signal from said flame sense monitor.

9. The control system of claim 8, wherein said flame sense monitor comprises a first transistor adapted to output said third signal, a second transistor adapted to output said fourth signal, and a flame sense detector.

10. The control system of claim 9, wherein said flame sense detector comprises a voltage divider circuit comprising a photocell and a resistor connected to form an output.

11. The control system of claim 10, wherein said photocell biases said first transistor, said first transistor biases said second transistor, and said second transistor provides feedback bias to said first transistor.

12. The control system of claim 11, further comprising first and second voltage threshold devices each having an input and an output, and a voltage adder.

13. The control system of claim 12, wherein each of said first and second transistors are PNP type transistors having a base, collector and an emitter.

14. The control system of claim 13, wherein said output of said first voltage threshold device is connected to said base of said first transistor, said first voltage threshold device being configured to allow current to flow from said base when a voltage is applied at said input which is below a predetermined breakdown voltage.

15. The control system of claim 14, wherein said output of said second voltage threshold device is connected to said base of said second transistor, said second voltage threshold device being configured to allow current to flow from said base when a voltage is applied at said input which is below a predetermined breakdown voltage.

16. The control system of claim 15, wherein said output of said voltage divider is connected to said input of said first voltage threshold device.

17. The control system of claim 16, wherein said collector of said first transistor is connected to said input of said second voltage threshold device.

18. The control system of claim 17, wherein said collector of said second transistor is connected to said input of said voltage adder, said output of said voltage adder being connected to said input of said voltage threshold device and said output of said voltage adder.

19. The control system of claim 18, wherein said voltage adder comprises a resistor whose resistance controls the amount of feedback current into said input of said first voltage threshold device.

20. The control system of claim 19, wherein said photocell has a first resistance at which said first transistor will turn "on" and a second resistance at which said first transistor will turn "off."

21. The control system of claim 20, wherein said first resistance is lower than said second resistance.

22. The control system of claim 8, further comprising a timer circuit adapted to output a fifth signal indicative that the TFI period has expired.

23. The control system of claim 22, further comprising a lock-out device connected to said flame sense monitor and said relay control circuit and adapted to output at least one lock-out signal to prevent said relay control from energizing said relays, said lock-out device being activated in response to said fourth signal from said flame sense monitor and said fifth signal from said timer circuit, said lock-out circuit comprising at least one capacitor adapted to maintain said lock-out signal when the thermostat is opened and a leakage drain circuit adapted to prevent said capacitor from being charged due to leakage currents.

24. The control system of claim 23, wherein said leakage current drain circuit comprises a transistor.

25. A method for controlling the operation of a heating system having a combustion chamber, an igniter and a pump motor selectively powered by an energy source to provide a spark and fuel to the combustion chamber, the method comprising the steps of:

applying a current through first and second relays:

determining whether the contacts of said relays are open using said current; and energizing said relays if said relay contacts are sensed open.

26. The method of claim 25, wherein said energizing step comprises the step of energizing said first relay after said second relay has been energized.

27. The method of claim 25, further comprising the step of detecting whether a flame is present in the combustion chamber.

28. The method of claim 27, wherein said flame detection step comprises the step of detecting flame at a first photocell resistance and detecting no flame at a second photocell resistance, said first resistance being lower than said second resistance.

29. A control system for controlling the operation of a heating system having a combustion chamber, a thermostat, an igniter, and a motor, the thermostat being adapted to generate a cell for heat, the igniter and motor being powered by a power source and adapted to supply a spark and fuel, the control system comprising:

(a) a relay circuit having first and second relays, said relays having an open position and an closed position, the external power source being connected to the igniter and motor through said first relay and said second relay and when said first and second relays are closed;

(b) means in electrical circuit with said relays for generating a first signal when said first or second relays are welded; and (c) means for energizing said first and second relays in response to the call for heat from the thermostat and said first signal.

30. The control system of claim 29, wherein said first means comprises a relay contact monitor configured to output a first signal when said relays are in said open position and a second signal when said relays are in said closed position.

31. The control system of claim 29, wherein said second means comprises a relay control circuit configured to energize said relays in response to the call for heat from the thermostat and said first signal from said relay contact monitor.

32. The control system of claim 29, further comprising third means for energizing said second relay after said first relay is energized.

33. The control system of claim 32, wherein said third means comprises a time delay circuit having a resistor and capacitor.

34. The control system of claim 29, further comprising fourth means for generating a third signal when a flame is detected in the combustion chamber and a fourth signal when a flame is not detected in the combustion chamber, said second means being further configured to energize said relays in response to said first signal, the call for heat from the thermostat, and said fourth signal.

35. The control system of claim 34, wherein said fourth means comprises means for detecting flame at a first photocell resistance level and no flame at a second photocell resistance level, said first resistance level being lower than said second resistance level.

36. A control system for controlling the operation of a heating system having a combustion chamber, an igniter powered by an electrical energy source and adapted to supply a spark to the combustion chamber, the control system comprising a pair of relays connected in circuit between the energy source and igniter for selectively connecting the energy source to the igniter through said first relay and said second relay, each of said relays having a movable part with a first position in which said pair of relays are adapted to provide electrical energy to the igniter from the energy source and a second position to interrupt the connection of the energy source to the igniter, said pair of relays being configured with time delay circuitry such that said pair of relays will not close at the same time.

37. The control system of claim 36, further comprising a monitor connected to said pair of relays and adapted to prevent said pair of relays from being initially energized when either of said relays is in said first position.

38. A control system for controlling the safe operation of a heating system having an igniter and a motor powered by an energy source, the control system comprising:

first and second relays each having an open position and a closed position, the energy source being connected to the igniter and motor through said first relay and said second relay and when both of said relays are in said closed position; and a relay monitor capable of sensing whether at least one of said relays is in said closed position when both of said relays should be in said open position prior to being energized so that the heating system will not be operated with an unsafe condition.

39. A control system for controlling the safe operation of a heating system having an igniter and a motor powered by an energy source, the control system comprising:

first and second relays having an open position and a closed position, the energy source being connected to the igniter and motor through said first relay and said second relay and when both of said relays are in said closed position; and time delay circuitry configured to prevent said relays from opening or closing at the same time.

40. A control system for controlling the operation of a heating system having a combustion chamber, an igniter and motor, the igniter and motor being powered by an energy source, the control system comprising:

first and second relays which when energized connect the electrical energy source to the igniter and motor through said first relay and said second relay; and lock-out circuitry configured to provide a lock-out signal to prevent energizing of said relays, said lock-out circuitry comprising a capacitor adapted to maintain said lock-out signal and a leakage drain circuitry adapted to prevent said capacitor from being accidentally charged due to leakage currents.

* * * * *